US008217284B2

(12) United States Patent
Dai et al.

(10) Patent No.: US 8,217,284 B2
(45) Date of Patent: Jul. 10, 2012

(54) ANTI DUMPING SWITCH AND DEVICE HAVING SAME

(75) Inventors: Qiaohua Dai, Guangdong (CN); Zhaobing Shou, Guangdong (CN); Hongwu Qin, Guangdong (CN); Jianwei Liu, Guangdong (CN); Xiaoyong Dong, Guangdong (CN)

(73) Assignee: Shenzhen H & T Intelligent Control Co., Ltd., Shenzhen, Guangdong (CN)

( * ) Notice: Subject to any disclaimer, the term of this patent is extended or adjusted under 35 U.S.C. 154(b) by 201 days.

(21) Appl. No.: 12/605,914

(22) Filed: Oct. 26, 2009

(65) Prior Publication Data

US 2010/0288605 A1 Nov. 18, 2010

(30) Foreign Application Priority Data

May 13, 2009 (CN) ..... 2009 1 0302271
May 13, 2009 (CN) ..... 2009 1 0302272

(51) Int. Cl.
*H01H 35/02* (2006.01)
*H01H 35/14* (2006.01)

(52) U.S. Cl. ..... 200/61.45 R; 200/61.52; 200/61.53

(58) Field of Classification Search 200/61.45 R–61.53; 73/504.12, 504.013, 514.16, 514.29, 514.35; 340/565, 566
See application file for complete search history.

(56) References Cited

U.S. PATENT DOCUMENTS 2,794,084 A * 5/1957 Segoni ..... 200/61.52
3,509,298 A * 4/1970 Kirk ..... 200/61.45 R
3,706,867 A * 12/1972 Rand et al. ..... 200/61.52
3,831,163 A * 8/1974 Byers ..... 340/539.31
4,467,153 A * 8/1984 Jones et al. ..... 200/61.45 R
4,628,160 A * 12/1986 Canevari ..... 200/61.45 R
5,194,707 A * 3/1993 Wallach ..... 200/61.45 R
5,237,135 A * 8/1993 Wolski ..... 200/61.45 R
5,837,951 A * 11/1998 Kato et al. ..... 200/61.45 R
6,028,275 A * 2/2000 Jou ..... 200/61.52
6,448,516 B1 * 9/2002 Chiang ..... 200/61.45 R
6,559,396 B1 * 5/2003 Chou ..... 200/61.52
7,351,925 B2 * 4/2008 Wehrenberg ..... 200/61.45 R

* cited by examiner

*Primary Examiner* — Michael Friedhofer

(74) *Attorney, Agent, or Firm* — Jackson IPG PLLC

(57) ABSTRACT

An anti dumping switch includes a circular and hollow housing, a bottom surface connected to the housing, a first switch end, a second switch end, a bush, and two balls, the housing and the bottom surface cooperatively defining a accommodating space, the first switch end and the second switch end both extending into the accommodating space through the bottom surface and fixed in the bottom surface, the balls being received in the accommodating space. When the anti dumping switch is flat the balls connecting the first switch end and when the anti dumping switch is dumped the balls disengage with the first switch end or the second switch end, wherein the first switch end is disposed at substantially a center of the bottom surface, the second switch end being disposed adjacent to the housing, the bush being received in the accommodating space and cycling the housing from inside and connecting the second switch end, the bush including a slope surface disposed adjacent to the bottom surface that make the balls contact the first switch end or the second switch end.

20 Claims, 10 Drawing Sheets

ANTI DUMPING SWITCH AND DEVICE HAVING SAME

The present invention relates to anti dumping switches and electronic devices employing such switches.

GENERAL BACKGROUND

In order to prevent household electrical appliances that have high voltage power supply (110V or 220V), such like heater, humidifier machine, vertical fan, etc., continuing to work when the dumping of man-made or other accidents occurs. That is to avoid additional accidents such as fire, electric shock, and injury to people, under the circumstance of the dumping of household electrical appliances in the non-normal state while the electrical appliances are still in work. The usual practice is to set anti-dumping appliances switches. When the household appliance is dumped or tilted to a certain angle, the power supply is disconnected, so that it stops working and accidents are avoided. However, generally most of the anti dumping switches are mechanical or photoelectric controlled switches, and the mechanical switches are low in reliability that can not ensure the safety when the appliances are dumped, and the photoelectric controlled switches are not cost effective and big in size, therefore the cost of photoelectric controlled switches is high and the installation thereof is difficult.

What is needed, therefore, is an anti dumping switch that can overcome the above-described deficiencies. What is also needed is a device employing such switch.

SUMMARY

It is an object of the present invention to provide an anti dumping switch of high reliability, low cost and small bulk.

It is another object of the present invention to provide an electrical device with an anti dumping switch of high reliability, low cost and small bulk.

In one exemplary embodiment of the present invention is an anti dumping switch including a circular and hollow housing, a bottom surface connected to the housing, a first switch end, a second switch end, a bush, and two balls, the housing and the bottom surface cooperatively defining a accommodating space, the first switch end and the second switch end both extending into the accommodating space through the bottom surface and fixed in the bottom surface, the balls being received in the accommodating space. When the anti dumping switch is flat the balls connecting the first switch end and when the anti dumping switch is dumped the balls disengage with the first switch end or the second switch end, wherein the first switch end is disposed at substantially a center of the bottom surface, the second switch end being disposed adjacent to the housing, the bush being received in the accommodating space and cycling the housing from inside and connecting the second switch end, the bush including a slope surface disposed adjacent to the bottom surface that make the balls contact the first switch end or the second switch end In another exemplary embodiment of the present invention is an anti dumping switch including a plurality of parallel switch units, wherein the switch unit comprises a hollow metal housing, a bottom surface connecting the metal housing, a first switch end, a second switch end, and a plurality of balls, the metal housing and the bottom surface defining an accommodating space, the first switch end, the second switch end and the balls being received in the accommodating space, wherein when the anti dumping switch is flat the balls connecting the first switch end and when the anti dumping switch is dumped the balls disengage with the first switch end or the second switch end, wherein the first switch end is disposed at substantially a center of the bottom surface, the second switch end being disposed adjacent to the housing, the bush being received in the accommodating space and cycling the housing from inside and connecting the second switch end, the bush including a slope surface disposed adjacent to the bottom surface that make the balls contact the first switch end or the second switch end.

In another exemplary embodiment of the present invention is an electronic device including an electrical part connected to external electrical power and configured for providing power supply for the electronic device, wherein further comprises an anti dumping switch as describes above, the anti dumping switch being connected between the electrical part and the electrical power, and configured for stop the electronic device working when the electronic device being dumped.

Other novel features and advantages will become more apparent from the following detailed description when taken in conjunction with the accompanying drawings.

BRIEF DESCRIPTION OF THE DRAWINGS

The components in the drawings are not necessarily drawn to scale, the emphasis instead being placed upon clearly illustrating the principles of at least one embodiment of the present invention. In the drawings, like reference numerals designate corresponding parts throughout various views, and all the views are schematic.

DETAILED DESCRIPTION OF PREFERRED EMBODIMENTS

Reference will now be made to the drawings to describe preferred and exemplary embodiments in detail.

Figure 1:
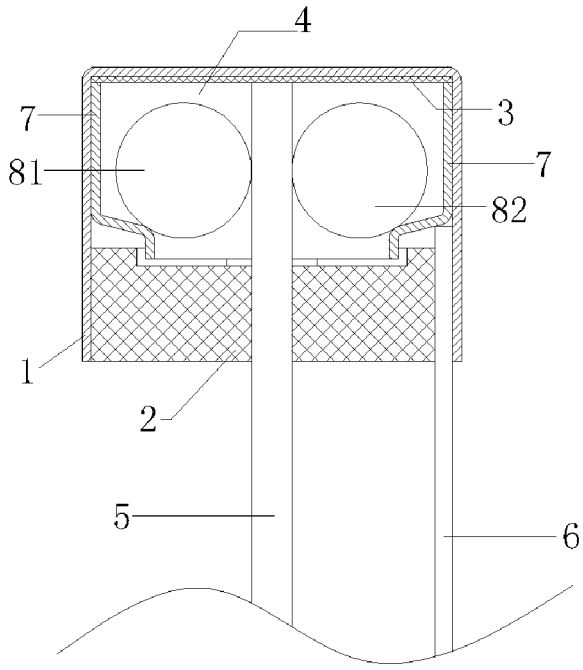
FIG. 1 is a plan view of an anti dumping switch according to a first embodiment of the present invention, the anti dumping switch including a bush, and two balls.

Referring to FIG. 1, the anti dumping switch includes a housing 1, a bottom surface 2, an insulation mat 3, a first switch end 5, a second switch end 6, a bush 7, two balls 81, 82. The housing 1 is connected with the bottom surface forming an accommodating space 4. The insulation mat 3, the bush 7, and the balls 81, 82 are received in the accommodating space 4. A part of the first switch end 5 penetrating a through hole of the bottom surface 2 into the accommodating space 4. The second switch end 6 extends into the accommodating space 4 through fringe area adjacent to an inner side of the housing 1. In alternative embodiments, the second switch end 6 can extend into the accommodating space 4 via a through hole of the bottom surface 2 without contacting the housing 1. The second switch end 6 contacts with the bush 7. The balls 81, 82 are disposed between the part of the first switch end 1 in the accommodating space 4 and the bush 7, which can be freely rolled therein. In the illustrated embodiment, the balls 81, 82 are made from conducted cooper metal with a gold plated covering thereof. The insulation mat 3 is disposed beneath a top surface of the housing 1, thus an inner side of the top surface of the housing 1 are isolated from a top surface of the bush 7 and the first switch end 5 by the insulation mat 3. The insulation mat 3 is also received by the accommodating space 4. The first switch end 5 in the accommodating space 4 reaches the insulation mat 3 such that the balls 81, 82 can be in touch with the first switch end 5. In the illustrated embodiment, the housing 1 is made of metal, thus the anti dumping switch has an improved EMC characteristics and is easy to be manufactured in low a production cost. In alternative embodiments, the housing 1 can be made of insulated material, such as insulated plastic with improved safety.

Figure 2:
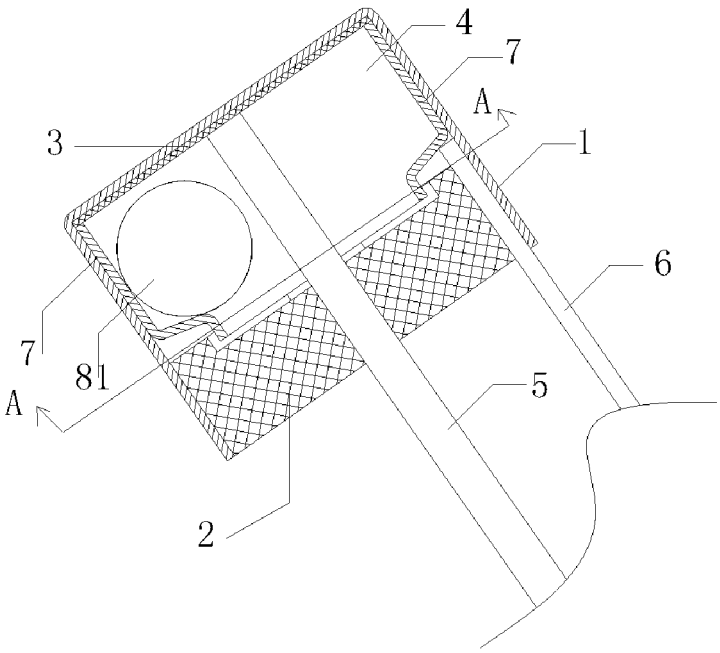
FIG. 2 is a schematic view of the anti dumping switch in FIG. 1 showing a position of the ball.

In the first embodiment, the housing 1 is circular and hollow, and has only top surface and side surface. A space is defined therein between the top surface and the side surface when the housing 1 is incorporated with the bottom surface 2, thereby forming the accommodating space 4. The first switch end 5 is fixed in the bottom surface 2 and penetrating through the through hole of the bottom surface 2. Referring also to FIG. 2, the bush 7 is in the accommodating space 4 and above the bottom surface 2, and circles around the side surface of the housing 1 from inside, thus the bush 7 has also a circular shape.

Figure 4:
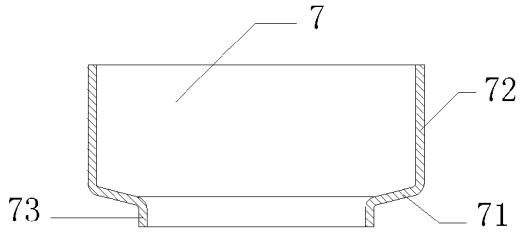
FIG. 4 is a cross-sectional view of the bush in FIG. 1.

Referring to FIG. 4, the bush 7 includes a first side surface 72, a slope surface 71 and a second side surface 73. The first side surface 72 and the second side surface 73 are connected by the slope surface 71 and integrated into one piece, thereby forming the bush 7. The first side surface 72 is above the slope surface 71 and adjacent to the side surface of the housing 1. The second side surface 73 is under the slope surface 71 and contacts the bottom surface 2, which is capable of supporting the bush 7. After assembling of the bush 7, a vertical distance between the first side surface 73 and the first switch end 5 is greater than a vertical distance of the second side surface 72 and the first switch end 5. The balls 81, 82 have a same diameter, which is greater than the distance between the second side surface 72 and the first switch end 5 and less than the distance between the first side surface 73 and the first switch end 5. Thus, when the balls 81, 82 are disposed between the bush 7 and the first switch end 5, because the bush 7 has the slope surface 71, the balls 81, 82 are unable of staying on the slope surface 71. Therefore, the balls 81, 82 rolls towards the oblique direction, and because the balls 81, 82 have the diameters greater than the distance between the second side surface 72 and first switch end 5, the balls 81, 82 stop between the slope surface 71 and the first switch end 5 when contacting the first switch end. Thus, in fact the balls 81, 82 connect the first switch end 5 and the second switch end 6.

Figure 3:
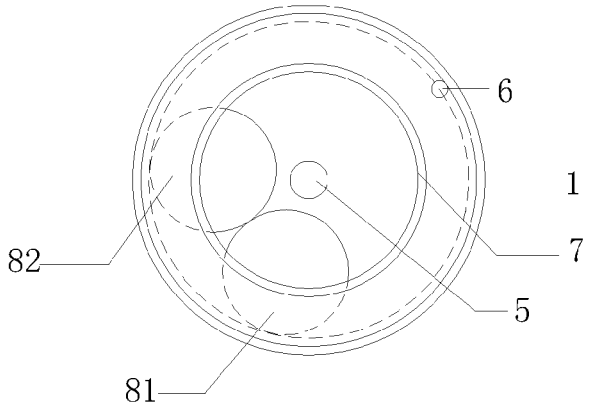
FIG. 3 is a cross-sectional view of the anti dumping switch along line A-A in FIG. 2.

In the first embodiment, the housing 1 has a certain height, which cooperated with a thickness of the bottom surface 2 decide a height of the accommodating space 4. The height of the accommodating space 4 is required to be greater than the diameter of the balls 81, 82, so as to ensure that the balls 81, 82 are rollable when the switch is tilted or dumped to a desired angle. In this case, when the switch is tilted or dumped to a desired angle, the balls 81, 82 roll along the slope surface 71 of the bush 7 and are disengaged with the first switch end 5, thus the first switch end 5 and the second switch end 6 are disconnected, as shown in FIGS. 2-3.

In the first embodiment, the diameter of the balls 81, 82 can be 3 mm. The housing 1 can have an outside diameter of 8.4 mm and a height of 6.5 mm. The insulation mat 3 can have a diameter of 8 mm, and a thickness of 0.15 mm, and can be made of PVC or PET. The bush 7 can have an outside diameter of 8 mm, and a height of 3.9 mm. The second switch end 6 can have a diameter of 0.4 mm and the first switch end can have a diameter of 0.9 mm. The bottom surface 2 can be made from ABS by an injection molding process, and can have an outside diameter of 8 mm and a height of 2.5 mm. When the anti dumping switch is dumped or tilted to a angle greater than between 35-55 degrees, the first switch end 5 and the second switch end 6 are disconnected.

Figure 5:
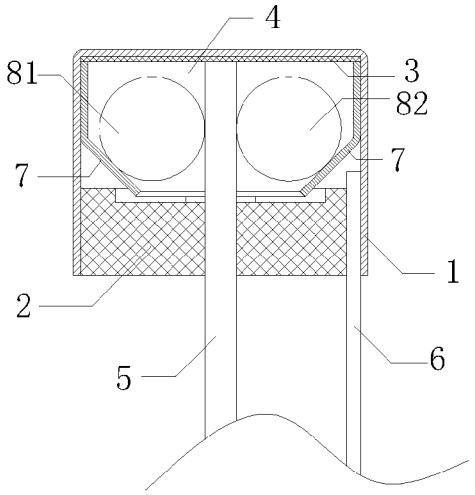
FIG. 5 is a plan view of an anti dumping switch according to a second embodiment of the present invention, the anti dumping switch including a bush, and two balls.
Figure 6:
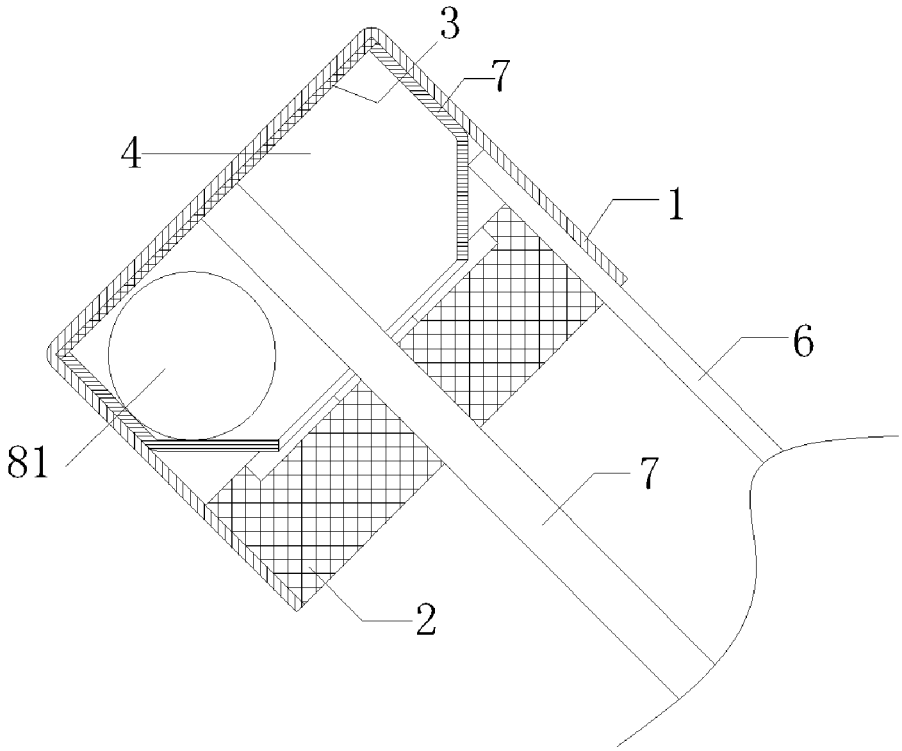
FIG. 6 is a schematic view of the anti dumping switch in FIG. 5 showing a position of the ball.
Figure 7:
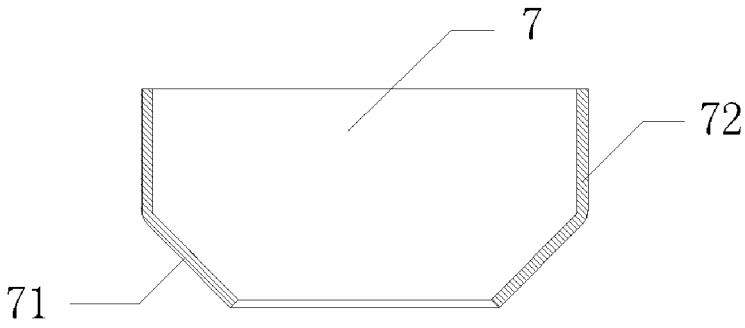
FIG. 7 is a cross-sectional view of the bush in FIG. 5.

Referring to FIGS. 5-7, an anti dumping switch according to a second embodiment of the present invention has a similar structure to that of the first embodiment, however, in the second embodiment the bush 7 has only the slope surface 71 and the first side surface 72, as shown in FIG. 7, the slope surface 71 contacts with the bottom surface 2, and is capable of supporting the bush 7. The slope surface 71 includes a top end and a bottom end, and the bottom end contacts with the bottom surface 2 and a certain distance from the first switch end 5. The top end of the slope surface 71 is connected to the first side surface 72. In the second embodiment, the balls 81, 82 have the same diameter as in the first embodiment. Furthermore, an angle between the slope surface 71 and the bottom surface 2 is 45 degrees, which is fit for rolling of the balls 81, 82.

In the second embodiment, the bush 7 has the 45 degrees slope surface 71, and an outside diameter of 8 mm and a height of 3.9 mm. When the switch is dumped or tilted to a angle greater than 45-60 degrees in arbitrary direction, the first switch end 5 and the second switch end 6 are disconnected.

Figure 8:
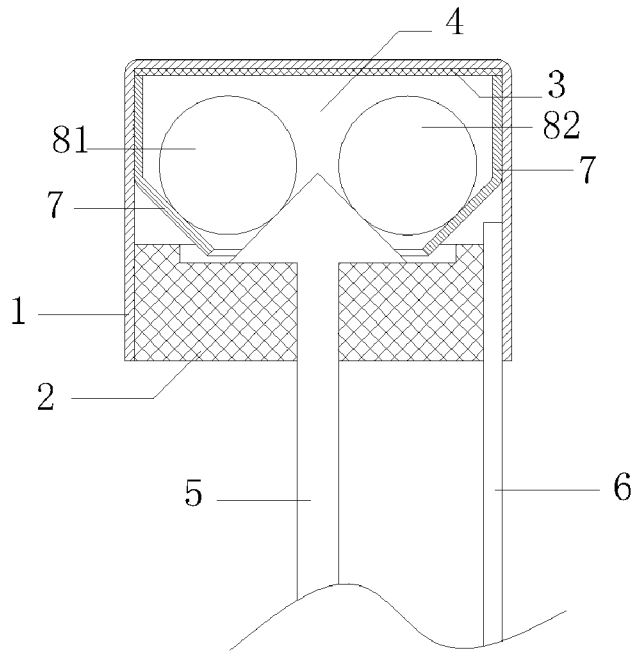
FIG. 8 is a plan view of an anti dumping switch according to a third embodiment of the present invention, the anti dumping switch including a first switch end.
Figure 9:
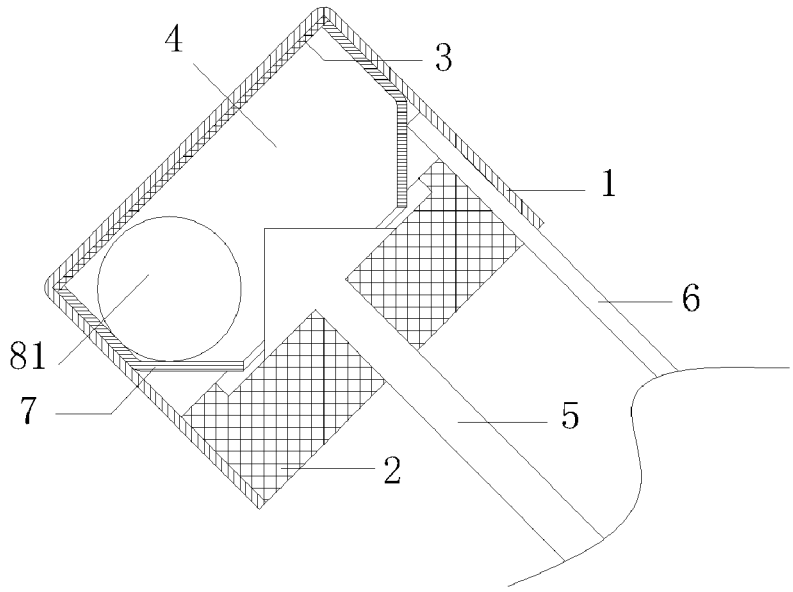
FIG. 9 is a schematic view of the anti dumping switch in FIG. 8 showing a position of the ball.
Figure 10:
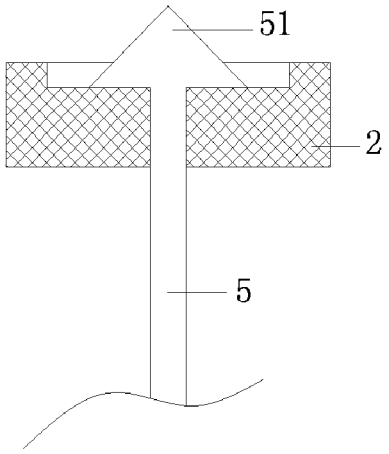
FIG. 10 is a cross-sectional view of the first switch end in FIG. 8.

Referring to FIGS. 8-10, an anti dumping switch according to a third embodiment of the present invention has a similar structure to that of the second embodiment. However, the part of the first switch end 5 in the accommodating space 4 has a shape of a centrum 51 with a 45 degrees base angle, which is different to the podetium of the other part of the first switch end 5 outside the accommodating space 4, as shown in FIG. 10. The centrum 51 has a bottom side very close to the bottom surface 2. The centrum 51 and the slope surface of the bush 7 constitute a funnel shaped cross section, as shown in FIGS. 8-9. When the switch is in normal state, the balls 81, 82 partly fall into the funnel formed by the slope surface 71 and the centrum 51, and the first switch end 5 and the second switch end 6 are connected, as shown in FIG. 8. When the switch is dumped, the balls 81, 82 roll out of the funnel, the first switch end 5 and the second end 6 are disconnected, as shown in FIG. 9. By adopting the above-described structure, the third embodiment can effectively improve the movement of the balls 81, 82 in the accommodating space 4, and the first switch end 5 can be easily fixed to the bottom surface 2.

In the third embodiment, the bush 7 has the slope surface of 45 degrees bas angle. The bush 7 has an outside diameter of 8 mm, and a height of 3.9 mm. The part of first switch end 5 in the accommodating space 4 has a structure of 45 degrees circular cone. When the switch is dumped or tilted to a angle greater than 45-60 degrees in arbitrary direction, the first switch end 5 and the second switch end 6 are disconnected.

Figure 11:
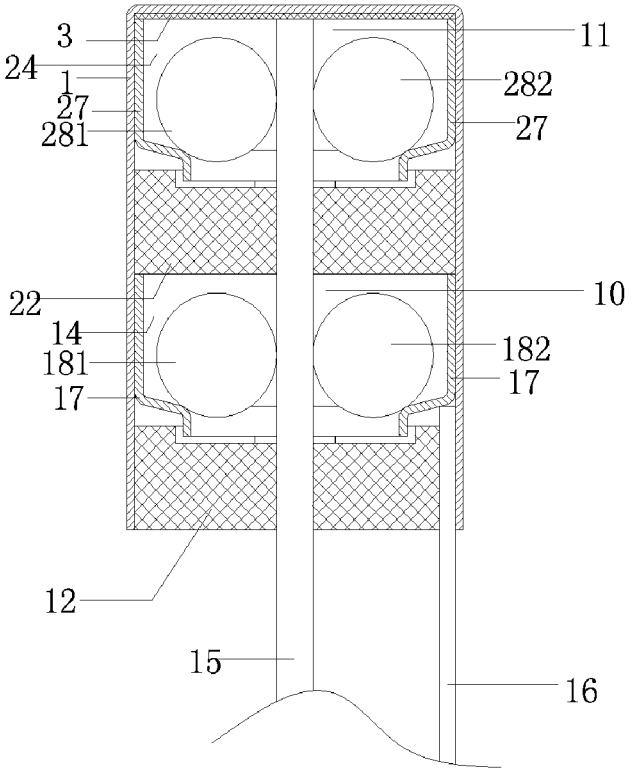
FIG. 11 is a plan view of an anti dumping switch according to a fourth embodiment of the present invention.

Referring to FIG. 11, an anti dumping switch according to a fourth embodiment of the present invention is shown. The switch includes two parallel switch units, namely a first switch unit 10 and a second switch unit 11. The second switch unit 11 is disposed above and connected to the first switch unit 10. The first switch unit 10 and the second switch unit 11 share a common metal housing 1, and the switch ends is drew out from a first switch end 15 and second switch end 16 of the first switch unit 10. That is, the first switch unit 10 and the second switch unit 11 have a same couple of switch ends 15, 16 and both are connected to the switch ends 15, 16. The first switch unit 10 has no metal cover on the top thereof and directly connects a bottom surface 22 of the second switch unit 11. The first switch end 15 extends into the second switch unit 11 through the second bottom surface 22. The first switch unit 10 has the second switch end 16 connected to a first bush 17. The first bush 17 is connected to a second bush 27 of the second switch unit 11 via the metal housing 1. The first switch unit 10 and the second switch unit have a similar structure. The first switch unit 10 includes the metal housing 1, a first bottom surface 12, the first switch end 15, the second switch end 16, the first bush 17, the balls 181, 182. The metal housing is connected with the first bottom surface 12 cooperatively forming a first accommodating space 14. The first bush 17 and the balls 181, 182 are received in the first accommodating space 14. A part of the first switch end 15 goes through the first bottom surface 12 via a through hole into the first accommodating space 14. The second switch end 16 goes into the first accommodating space 14 via a slot between an edge area of the first bottom surface 12 and the housing 1. The second switch end 16 can also extend into the first accommodating space 14 via a through hole in alternative embodiments. The second switch end 16 is connected with the first bush 17. The balls 181, 182 are disposed between the part of first switch end 15 in the first accommodating space 14 and the first bush 17 and can be freely rolled therein. In the fourth embodiment, the balls 181, 182 are made of copper with gold plated covering. The first switch end 15 extends up that the balls 181, 182 can contact the first switch end 15. In the fourth embodiment, the metal housing 1 is made of metal, thus the anti dumping switch has an improved EMC characteristics and is easy to be manufactured in low a production cost. In addition, the metal housing 1 is capable of connecting the first bush 17 and the second bush 27. The second switch unit 11 has a substantially same structure. The second switch unit 11 includes the second bush 17 and balls 281, 282. However, a insulation mat 3 is disposed between in a second accommodating space 24 of the second switch unit 11. The insulation mat is disposed under the top of the metal housing 1, thus the inner side of the top surface of the metal housing 1 is isolated from a top surface of the second bush 27 and part of the first switch end 15 extending into the second accommodating space 24.

Figure 14:
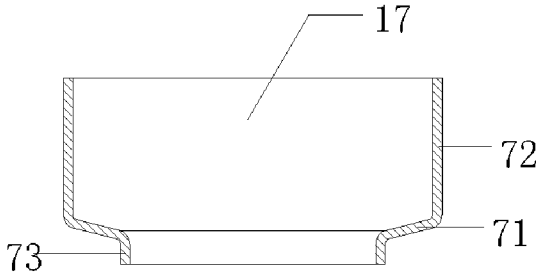
FIG. 14 is a cross-sectional view of the bush in FIG. 11.

In the fourth embodiment, the metal housing is circular and hollow, having only top surface and side surface. The top surface and side surface thereof defined a space, when the first bottom surface 12 is connected to the metal housing 1, the first accommodating space 14 is formed. The second bottom surface 22 and the metal housing cooperatively define the second accommodating space 24. The first switch end 15 extends into the first accommodating space 14 via a through hole substantially in a center of the first bottom surface 12, and extends up to through the second bottom surface 22 into the second accommodating space 24 and is fixed in with the first bottom surface 12 and the second surface 22. The first bush 17 is also disposed on the first bottom surface 12 and in the first accommodating space 14, and because of around the side surface of the metal housing 1, the first bush 17 is ring-shaped. Referring to FIG. 14, in the fourth embodiment, the first bush 17 includes a first side surface 72, a slope surface 71, and a second surface 73. The first side surface 72 is connected to the second side surface 73 via the slope surface 71, thereby forming the first bush 17. The first side surface 72 is above the slope surface 71, and is adjacent to the side surface of the metal housing 1. The second side surface 73 is under the slope surface 71 and contacts the first bottom surface 12 to support the first bush 17. A vertical distance between the first side surface 73 and the first switch end 15 is greater than a vertical distance between the second side surface 72 and the first switch end 15. The balls 181, 182 have the same diameter that greater than the distance between the second side surface 72 and the first switch end 15 and less than the distance between the first side surface 73 and the first switch end 15. Thus, when the balls are between the first bush 17 and the first switch end 15, the balls 181, 182 are unable to stay on the slope surface 71 and roll toward the oblique direction thereof. Because the diameter is greater than the vertical distance between the second side surface 72 and the first switch end 15, the balls 181, 182 stop at where between the slope surface 71 and the first switch end 15 and contacts the first switch end 15 and the slope surface 71 simultaneously. The second switch end 16 is connected with the first bush 17, thus the first switch end 15 and the second switch end 16 are actually connected by the balls 181, 182. The second switch unit 11 has a similar detailed structure as the first switch unit 10.

Figure 12:
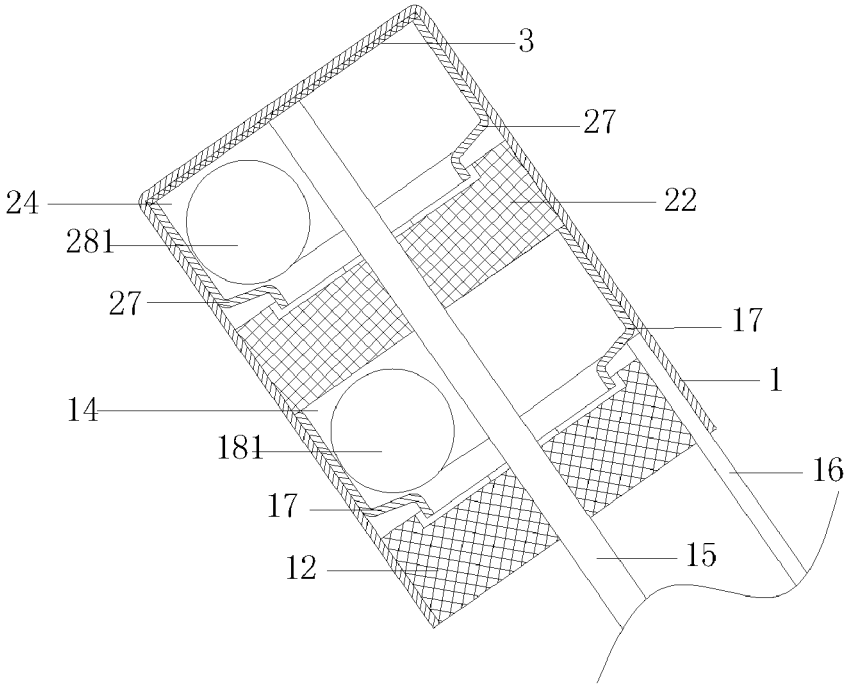
FIG. 12 is a schematic view of the anti dumping switch in FIG. 11 showing a position of the ball.
Figure 13:
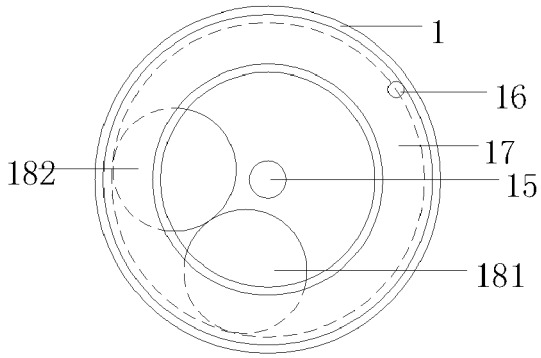
FIG. 13 is a cross-sectional view of the anti dumping switch along line A-A in FIG. 11.

In the fourth embodiment, the metal housing 1 has a height that allows the first switch unit 10 and the second switch unit 11. The height of the metal housing 1 and a height of the first bottom surface 12, the second bottom surface 22, and a distance between them decide a height of the first accommodating space 14 and a height of the second accommodating space 24 (shown in the vertical direction in FIG. 11). The heights of the first accommodating space 14 and the second accommodating space 24 need to be greater than the diameters of the balls 181, 182 and the balls 281, 282 respectively, thus the balls 181, 182 and balls 281, 282 can roll along the slope surface when the switch is dumped and be disengaged with the first switch end 15, such that the first switch end 15 and the second switch end 16 are disconnected, as shown in FIG. 12.

In the fourth embodiment, the balls 181, 182, 281, 282 have a same diameter of 3 mm. The metal housing has an outside diameter of 8.4 mm, and a height of 12.6 mm. The insulation mat 3 has a diameter of 8 mm and thickness of 0.15 mm. The first bush 17 and the second bush 27 have outside diameters of 8 mm, and heights of 3.9 mm. The second switch end 16 has a diameter of 0.4 mm. The first switch end 15 has a diameter of 0.9 mm. The first bottom surface 12 and the second bottom surface 22 are made of ABS plastic by an injection process, whose outside diameters are 8 mm, and heights are 2.5 mm. In the fourth embodiment, when the switch is dumped to an angle greater than between 35 degrees and 55 degrees, the first switch 15 end and the second switch end 16 are disconnected.

Figure 15:
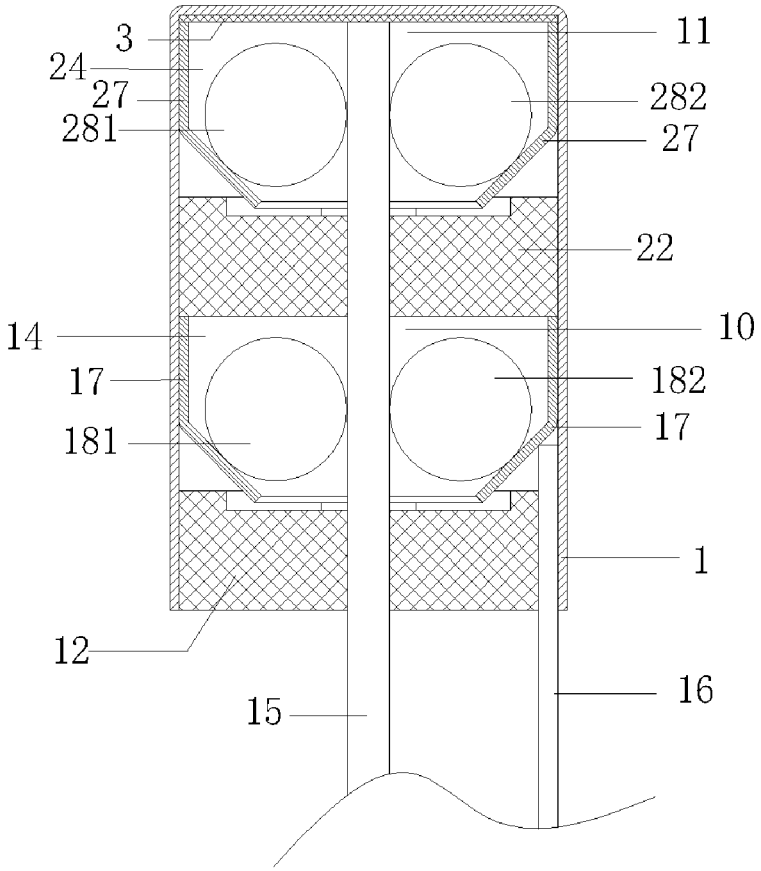
FIG. 15 is a plan view of an anti dumping switch according to a fifth embodiment of the present invention.
Figure 16:
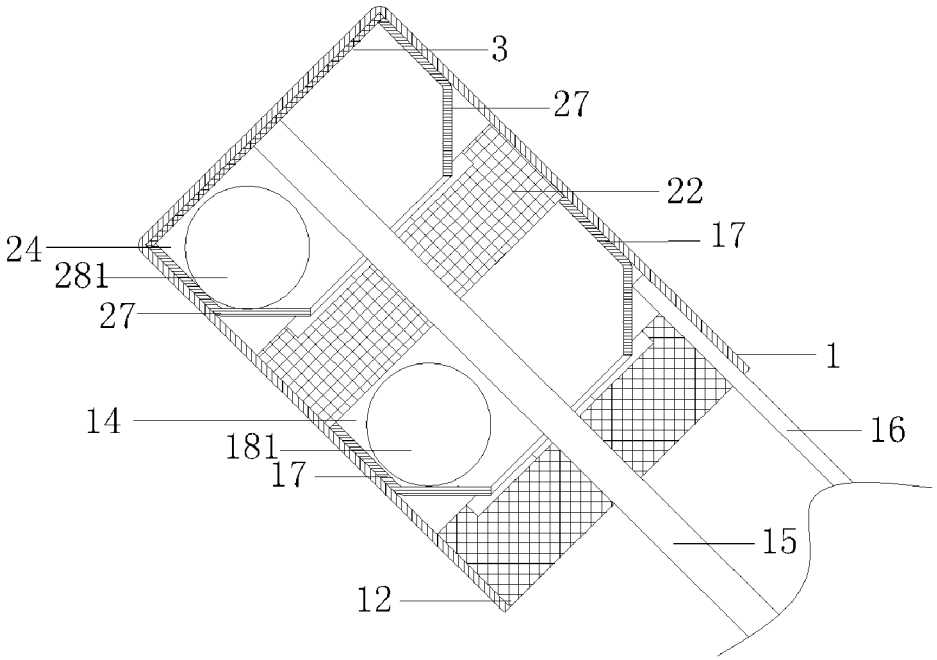
FIG. 16 is a schematic view of the anti dumping switch in FIG. 15 showing a position of the ball.
Figure 17:
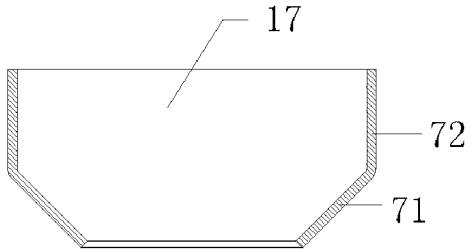
FIG. 17 is cross-sectional view of the bush in FIG. 15.

Referring to FIGS. 15-17, an anti dumping switch according to a fifth embodiment of the present invention is shown. The anti dumping switch of fifth embodiment has a similar structure to that of the fourth embodiment. However, in the fifth embodiment, the first bush 17 and the second bush 27 have the same structure, and take the first bush 17 as example. The first bush 17 includes only a first side surface 72 and a slope surface 71. The slope surface 71 contacts the first bottom surface 12 to support the first bush 17. The slope surface 71 includes a top end and a bottom end. The top end contacts the first side surface 72, and the bottom end contacts the first bottom surface 12 and is a certain distance away from the first switch end 15. The balls 181, 182 have a same diameter as in the first embodiment. Furthermore, an angle between the slope surface 71 and the bottom surface 2 is 45 degrees, which is fit for rolling of the balls 181, 182 in the first accommodating space 14. In the fifth embodiment, the second bush 27 has a same structure as the first bush 17, and a bottom end of the slope surface contacts the second bottom surface 22.

In the fifth embodiment, the first and second bushes have 45 degrees slope surface therebelow, with the outside diameter of 8 mm and the height of 3.9 mm. When the switch is dumped to an angle between 45-60 degrees at arbitrary direction, the first switch end 15 and the second switch end 16 are disconnected.

Figure 18:
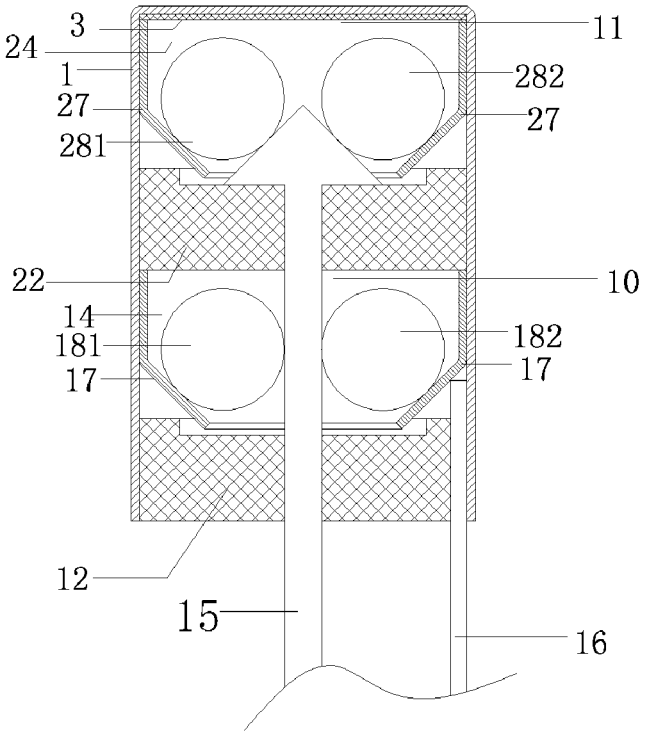
FIG. 18 is a plan view of an anti dumping switch according to a sixth embodiment of the present invention.
Figure 19:
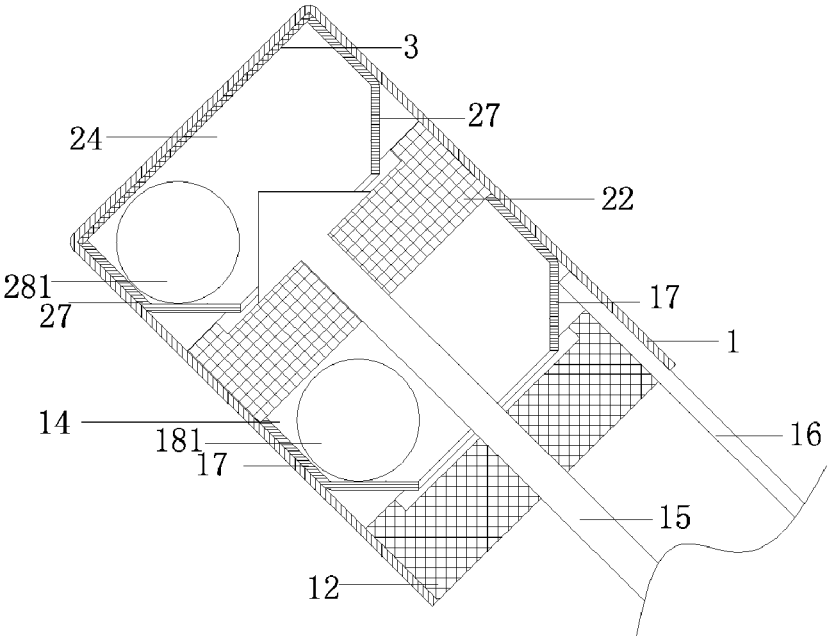
FIG. 19 is a schematic view of the anti dumping switch in FIG. 18 showing a position of the ball.
Figure 20:
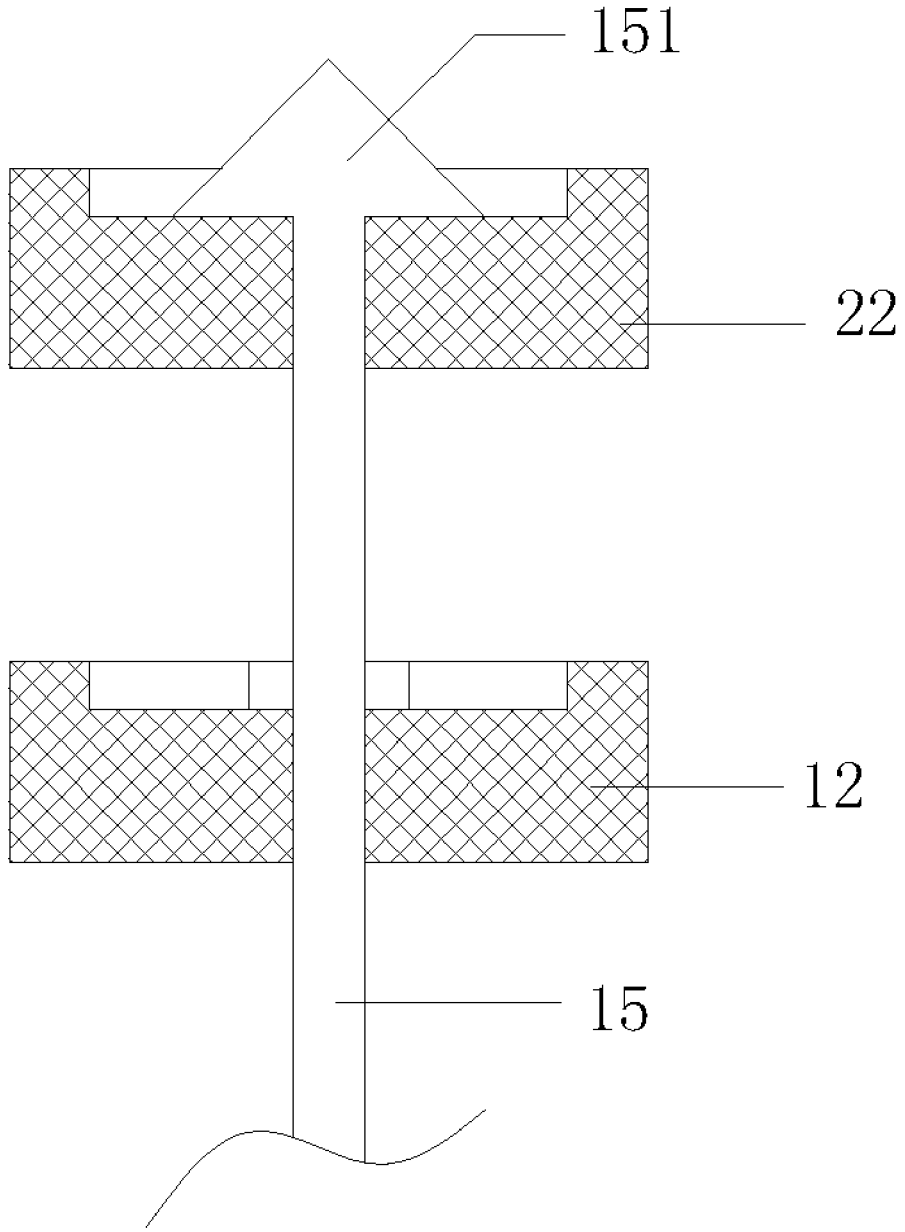
FIG. 20 is a cross-sectional view of the first switch end in FIG. 18.

Referring to FIGS. 18-20, an anti dumping switch according to a sixth embodiment of the present invention is shown. The switch of the sixth embodiment has a similar structure to that of the fifth embodiment. However, the part of the first switch end 15 in the second accommodating space 24 has a shape of a centrum 151 with a 45 degrees base angle, which is different to the podetium of the other part of the first switch end 5 outside or in the first accommodating space 14, as shown in FIG. 20. The centrum 151 has a bottom side very close to the bottom surface 22. The centrum 151 and the slope surface of the second bush 27 constitute a funnel shaped cross section. When the switch is in normal state, the balls 281, 282 partly fall into the funnel formed by the slope surface 71 and the centrum 51, and the first switch end 15 and the second switch end 16 are connected, as shown in FIG. 18. When the switch is dumped, the balls 281, 282 roll out of the funnel, the first switch end 15 and the second end 16 are disconnected, as shown in FIG. 19. By adopting the above-described structure, the sixth embodiment can effectively improve the movement of the balls 281, 282 in the second accommodating space 24, and the first switch end 15 can be easily fixed to the second bottom surface 22.

In the sixth embodiment, the first and second bushes 17, 27 have the slope surfaces of 45 degrees bas angle. The bushes 17, 27 have outside diameters of 8 mm, and heights of 3.9 mm. The part of first switch end 5 in the second accommodating space 24 has a structure of 45 degrees circular cone. When the switch is dumped or tilted to an angle greater than 45-60 degrees in arbitrary direction, the first switch end 15 and the second switch end 16 are disconnected.

The above-described embodiments have disclosed different structures of bushes, but in each embodiment the structure of the bushes are the same. However, in other alternative embodiments the structures of the bushes in one embedment can also be different. For example, the structure of the bush of the fourth embodiment can be used to the first switch unit, and the structure of the bush of the fifth embodiment can be used to the second switch unit. In short, the structures of the bushes and the first switch end can be changeable according to different requirement.

The present invention further provides an electronic device that includes a power driver or power control part, such like electric fan, heater. The power driver or the power control part is connected to electrical power supply and accomplish functions. The electronic device includes an anti dumping switch, which can be any one according to the embodiments described above. The anti dumping switch is connected between the power driver or the power control part and the electrical power supply. When the electronic device is in normal working state, usually in a standing state, the electronic device is powered on and starts to work. If the electronic device is in an abnormal working state, such like being dumped down, the power supply is shut down by disconnecting the power driver or the power control part and the electrical power supply, and the electronic device stops working.

It is to be understood, however, that even though numerous characteristics and advantages of exemplary and preferred embodiments have been set out in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An anti dumping switch comprising:

a cylindrical and hollow housing, a bottom surface connected to the housing, a first switch end, a second switch end, a cylindrical conductive bush, and two conductive balls, the housing and the bottom surface cooperatively defining a accommodating space, the first switch end extending into the accommodating space through the bottom surface and fixed in the bottom surface, the balls being received in the accommodating space, wherein when the anti dumping switch is flat the balls electrically connect the first switch end and the second switch end and when the anti dumping switch is dumped the balls disengage with the first switch end, wherein the first switch end is disposed at substantially a center of the bottom surface, the second switch end being disposed adjacent to the housing, the bush being received in and extending a height of the accommodating space and configured to encircle an interior cylindrical surface of the housing and connected to the second switch end, the bush comprising a slope surface disposed adjacent to the bottom surface that make the balls contact or disengage the first switch end.

2. The anti dumping switch as claimed in claim 1, wherein a diameter of the ball is greater than a distance between an end of the slope surface adjacent to the bottom surface and the first switch end and less than a distance the other end of the slope surface remote from the bottom surface and the first switch end.

3. The anti dumping switch as claimed in claim 2, wherein the two balls are separately disposed between the bush and the first switch end.

4. The anti dumping switch as claimed in claim 3, wherein the bottom surface comprises a through hole defined in the center corresponding to the first switch end and a through hole or a slot disposed at edge areas corresponding to the second switch end.

5. The anti dumping switch as claimed in claim 1, wherein the housing is metal and wherein the switch further comprises an insulation mat disposed under a top surface of the housing which isolates the first switch end from the housing.

6. The anti dumping switch as claimed in claim 5, wherein the bush further comprises a first side surface, the bottom of the slope surface contacts the bottom surface, the balls having the diameters less than a distance between an outside surface of the first switch end and the first side surface and greater than a distance between the outside surface of the first switch end and the bottom of the slope surface.

7. The anti dumping switch as claimed in claim 6, wherein part of the first switch end in the accommodating space is centrum-shaped.

8. The anti dumping switch as claimed in claim 7, wherein a base angle of the centrum-shaped part of the first switch end in the accommodating space is between 30-60 degrees.

9. The anti dumping switch as claimed in claim 5, wherein the bush comprises a slope surface, a first side surface and a second side surface, the first side surface connecting the second side surface via the slope surface, the first side surface surround the housing from inside, the second side surface contacting the bottom surface, a distance from the first side surface to the first switch end being greater than a distance between the second side surface and the first switch end.

10. The anti dumping switch as claimed in claim 9, wherein the balls and the bush are made from copper with gold plated coverings.

11. An anti dumping switch comprising a plurality of parallel switch units, wherein each switch unit comprises a hollow metal housing, a bottom surface connecting the metal housing, a first switch end, a second switch end, a conductive bush, and a plurality of balls, the metal housing and the bottom surface defining an accommodating space, the first switch end, the second switch end and the balls being received in the accommodating space, wherein when the anti dumping switch is flat the balls connecting the first switch end and when the anti dumping switch is dumped the balls disengage with the first switch end, wherein the first switch end is disposed at substantially a center of the bottom surface, the second switch end being disposed adjacent to the housing, the bush being received in the accommodating space such that an interior side surface of the accommodating space is conductive and connecting the second switch end, the bush comprising a slope surface disposed adjacent to the bottom surface that make the balls contact or disengage the first switch end.

12. The anti dumping switch as claimed in claim 11, wherein the plural switch units comprises a first switch unit and a second switch unit disposed above the first switch unit, the first switch unit and the second switch unit sharing a first switch end and a second switch end, the first switch end extending into an accommodating space of the second switch unit, the first switch unit having a bush electrically connected to a bush of the second switch unit via the metal housing and connected to the second switch end.

13. The anti dumping switch as claimed in claim 12, wherein the balls have diameters greater than a distance between from an end of the slope surface adjacent to the bottom surface and the first switch end, and less than a distance between from an end of the slope surface remote to the bottom surface and the first switch end.

14. The anti dumping switch as claimed in claim 13, wherein an amount of the balls is two, the two balls being disposed between the bush and the first switch end.

15. The anti dumping switch as claimed in claim 14, wherein the bottom surface comprises a through hole defined in the center corresponding to the first switch end and a through hole or a slot disposed at edge areas corresponding to the second switch end.

16. The anti dumping switch as claimed in claim 15, wherein further comprises an insulation mat disposed under a top surface of the housing which isolates the first switch end from the housing.

17. The anti dumping switch as claimed in claim 16, wherein the bush further comprises a first side surface, the bottom of the slope surface contacts the bottom surface, the balls having the diameters less than a distance between an outside surface of the first switch end and the first side surface and greater than a distance between the outside surface of the first switch end and the bottom of the slope surface.

18. The anti dumping switch as claimed in claim 17, wherein part of the first switch end in the accommodating space is centrum-shaped, and a base angle of the centrum-shaped part of the first switch end in the accommodating space is between 30-60 degrees.

19. The anti dumping switch as claimed in claim 16, wherein the bush comprises a slope surface, a first side surface and a second side surface, the first side surface connecting the second side surface via the slope surface, the first side surface surround the housing from inside, the second side surface contacting the bottom surface, a distance from the first side surface to the first switch end being greater than a distance between the second side surface and the first switch end.

20. An electronic device comprising an electrical part connected to external electrical power and configured for providing power supply for the electronic device, wherein further comprises an anti dumping switch as claimed in any one of claim 1 to claim 19, the anti dumping switch being connected between the electrical part and the electrical power, and configured for stop the electronic device working when the electronic device being dumped.

* * * * *